US009835045B2

(12) United States Patent
Laubender et al.

(10) Patent No.: US 9,835,045 B2
(45) Date of Patent: Dec. 5, 2017

(54) EXHAUST GAS TURBOCHARGER, IN PARTICULAR FOR A MOTOR VEHICLE

(71) Applicant: Bosch Mahle Turbo Systems GmbH & Co. KG, Stuttgart (DE)

(72) Inventors: Jochen Laubender, Ingolstadt (DE); Marcus Schneider, Kornwestheim (DE)

(73) Assignee: Bosch Mahle Turbo Systems GmbH & Co. KG (DE)

( * ) Notice: Subject to any disclaimer, the term of this patent is extended or adjusted under 35 U.S.C. 154(b) by 410 days.

(21) Appl. No.: 14/556,789

(22) Filed: Dec. 1, 2014

(65) Prior Publication Data

US 2015/0159502 A1 Jun. 11, 2015

(30) Foreign Application Priority Data

Nov. 29, 2013 (DE) ..... 10 2013 224 572

(51) Int. Cl.
*F01D 17/16* (2006.01)
*F01D 5/14* (2006.01)

(52) U.S. Cl.
CPC ..... *F01D 17/165* (2013.01); *F01D 5/141* (2013.01); *F05D 2220/40* (2013.01)

(58) Field of Classification Search
CPC ..... F01D 17/165; F01D 5/141; F01D 9/02; F01D 9/045; F01D 17/16; F05D 2220/40; F02B 37/24
See application file for complete search history.

(56) References Cited

U.S. PATENT DOCUMENTS 6,948,907 B2 * 9/2005 Vogiatzis ..... F01D 17/165 415/160
8,109,715 B2 * 2/2012 Renaud ..... F01D 5/141 415/160

(Continued)

FOREIGN PATENT DOCUMENTS

DE 10238413 A1 3/2004
DE 102007007199 A1 8/2008
WO WO-2013080795 A1 6/2013

OTHER PUBLICATIONS

English abstract provided for DE-102007007199.
English abstract for DE-10234413.
German Search Report for DE-102013224572.6, dated Jun. 23, 2014.

*Primary Examiner* — Gregory Anderson
*Assistant Examiner* — Eldon Brockman
(74) *Attorney, Agent, or Firm* — Fishman Stewart PLLC

(57) ABSTRACT

An exhaust gas turbocharger may include a turbine housing and a turbine wheel. The turbine wheel may include a first quantity of a plurality of moving blades. The turbine wheel may be rotatable relative to the turbine housing about a turbine wheel center of rotation and have a turbine wheel radius. A variable turbine geometry may include a blade bearing ring on which a second quantity of a plurality of guide blades are rotatably mounted in each case about a guide blade center of rotation. The plurality of guide blades may be adjustable between a closed position, in which a flow cross section between the guide blades for an exhaust gas to flow through is at a minimum, and an opened position, in which the flow cross section is at a maximum.

20 Claims, 3 Drawing Sheets

(56) References Cited

U.S. PATENT DOCUMENTS

| | | | | |
|---|---|---|---|---|
| 8,414,253 | B2 * | 4/2013 | Severin | F01D 9/02 29/889.21 |
| 9,528,386 | B2 * | 12/2016 | Morita | F01D 5/141 |
| 2003/0039543 | A1 * | 2/2003 | Osako | F01D 9/045 415/150 |
| 2003/0079474 | A1 * | 5/2003 | Finger | F01D 17/165 60/602 |
| 2004/0223840 | A1 * | 11/2004 | Vogiatzis | F01D 17/165 415/1 |
| 2005/0220616 | A1 | 10/2005 | Vogiatzis et al. | |
| 2008/0131267 | A1 * | 6/2008 | Renaud | F01D 5/141 415/160 |
| 2010/0080694 | A1 * | 4/2010 | Chapman | F02B 37/24 415/160 |
| 2010/0104423 | A1 * | 4/2010 | Severin | F01D 9/02 415/159 |
| 2010/0104425 | A1 * | 4/2010 | Tries | F01D 9/045 415/160 |
| 2014/0341729 | A1 | 11/2014 | Osako et al. | |

* cited by examiner

EXHAUST GAS TURBOCHARGER, IN PARTICULAR FOR A MOTOR VEHICLE

CROSS-REFERENCE TO RELATED APPLICATIONS

This application claims priority to German Patent Application No. 10 2013 224 572.6, filed Nov. 29, 2013, the contents of which are hereby incorporated by reference in their entirety.

TECHNICAL FIELD

The present invention relates to an exhaust gas turbocharger, in particular for a motor vehicle, and to a motor vehicle having such an exhaust gas turbocharger.

BACKGROUND

As is known, exhaust gas turbochargers for internal combustion engines consist of two flow machines: on the one hand of a turbine, on the other hand of a compressor. The turbine utilises the energy contained in the exhaust gas for driving the compressor, which sucks in fresh air and introduces compressed air into the cylinders of the internal combustion engine. Because of the usually very high rotational speed range of the internal combustion engine, controlling the exhaust gas turbocharger is required so that as constant as possible a charge pressure can be ensured in as large as possible a rotational speed range of the internal combustion engine. Solutions are known for this according to which a part of the exhaust gas flow is conducted about the turbines by means of a bypass channel. However, the so-called variable turbine geometry makes possible an energetically more favourable solution with which the dynamic pressure behaviour of the turbine can be continuously varied and thus the entire exhaust gas utilised in each case. Such variable turbine geometry is conventionally realised by means of adjustable guide blades, with the help of which the desired exhaust gas flow through an exhaust gas turbocharger can be variably adjusted.

Invariable turbine geometries with adjustable guide blades it proves to be problematic that through the tapering channels between the guide blades the pulsating exhaust gas ejections of the engine are accelerated and strike the blades of the turbine wheel with a greater impulse, which can lead to the excitation of natural oscillations in the turbine wheel blades proper, and over the running period lead to fatigue fractures and thus destruction of the turbocharger.

SUMMARY

The present invention therefore deals with the problem of showing new ways in the development of variable turbine geometries and in the process provide in particular a variable turbine geometry that has improved thermodynamic efficiency.

This object is solved through the subject of the independent patent claims. Preferred embodiments are subject of the dependent patent claims.

Accordingly, the basic idea of the invention is to equip an exhaust gas turbocharger with a variable turbine geometry comprising guide blades, wherein the guide blades are adjustable between a closed position, in which a flow cross section between the guide blades for exhaust gas to flow through is minimal and an opened position, in which this flow cross section is maximal. Each guide blade in the longitudinal profile has a first profile nose facing away from the turbine wheel centre of rotation and a second profile nose facing the turbine wheel centre of rotation, the straight connecting line of which defines a profile chord. According to the invention, the spacing $R_{TE}$ of the second profile nose from the turbine wheel centre of rotation in the opened position of the guide blades and the radius of the turbine wheel $R_{TR}$ satisfy the following relationship:

$$1.03 \leq R_{TE}/R_{TR} \leq 1.06.$$

The design configuration of the exhaust gas turbocharger according to the invention diminishes undesirable excitation oscillations or oscillation loads on the various components to a considerable degree, which has a positive effect on the thermodynamic efficiency of the exhaust gas turbocharger. At the same time, the adjusting forces needed for moving the guide blades are minimised. The hysteresis behaviour of the variable turbine geometry is also improved, as a result of which good control behaviour can be achieved.

Particularly advantageous with respect to the efficiency to be achieved proves to be an embodiment, in which the spacing $R_{TE}$ and the radius $R_{TR}$ satisfy the following relationship:

$$1.04 \leq R_{TE}/R_{TR} \leq 1.06,$$

preferentially $1.05 \leq R_{TE}/R_{TR} \leq 1.06$.

Particularly practically, the centre line in the longitudinal profile of the guide blade is subdivided by the guide blade centre of rotation into a first chord with chord length $L_1$ and a second chord with chord length $L_2$. The first chord is defined according to this version by a connecting straight line of the guide blade centre of rotation with the first profile nose and the second chord by a connecting straight line of the guide blade centre of rotation with the second profile nose.

A particularly high efficiency of the exhaust gas turbocharger is now achieved when the guide blades are designed in such a manner that exhaust gas entering the turbine housing strikes the guide blade at an inflow angle $\alpha < 4°$ relative to the first chord when the guide blades are in their closed position.

In a preferred embodiment, the angle $\xi_2$ between a connecting straight line connecting the turbine wheel centre of rotation and the second profile nose and the first chord are in the following angle interval:

$35° \leq \xi_2 \leq 55°$, in the case that the guide blades are in the opened position, and $95° \leq \xi_2 \leq 110°$, in the case that the guide blades are in the closed position.

In a further particularly preferred embodiment, the angle $\xi_1$ between a connecting straight line connecting the turbine wheel centre of rotation and the second profile nose and the second chord satisfy one of the two following relationships:

$$1.4 \leq \xi_2/\xi_1 \leq 1.6, \text{ or}$$

$$1.2 \leq \xi_2/\xi_1 \leq 1.4.$$

Advantageously, the angle $\chi$ formed with respect to the turbine wheel centre of rotation as apex point between two adjacent guide blade centres of rotation P and the opening angle $\kappa$ of a moving blade in longitudinal section obey the following relationship:

$$0.4 \leq \chi/\kappa \leq 2.4,$$

preferentially $0.6 \leq \chi/\kappa \leq 1.7$, most preferentially $0.9 \leq \chi/\kappa \leq 1.2$.

In an advantageous further development of the exhaust gas turbocharger according to the invention, the length $S_2$ of the connecting line of two adjacent second profile noses in the opened state of the guide blades and the inlet width $S_3$ between two adjacent moving blades obey the following relationship:

$$0.45 \leq S_2/S_3 \leq 3.2,$$

preferably $0.65 \leq S_2/S_3 \leq 1.7$, most preferably $0.92 \leq S_2/S_3 \leq 1.25$.

In another preferred embodiment, the ratio of a flow area $A_{TR}$ between two moving blades with respect to the inlet area $A_{LS}$ between two guide blades obeys the following relationship:

$$0.36 \leq A_{LS}/A_{TR} \leq 3.82,$$

preferentially $0.52 \leq A_{LS}/A_{TR} \leq 2.05$, most preferably $0.74 \leq A_{LS}/A_{TR} \leq 1.5$.

Here, the inlet area $A_{TR}$ between two guide blades is defined by the relationship $A_{TR}=h_{TR}\ S_3$ and the inlet area $A_{LS}$ between two guide blades by the relationship $A_{LS}=h_{LS}\ S_2$. Here, $h_2$ is the height of the guide blade along its axis of rotation and $h_3$ the height of the moving blade on the turbine wheel inlet.

Particularly favourable in terms of flow dynamics is an embodiment in which the ratio of the height $h_{TR}$ of a moving blade with respect to the height $h_{LS}$ of a guide blade satisfies the following relationship:

$$0.8 \leq h_{LS}/h_{TR} \leq 1.2,$$

preferentially $0.9 \leq h_{LS}/h_{TR} \leq 1.1$.

According to an advantageous further development, the ratio of a diameter $D_{TR}$ of a moving blade with respect to the height $h_{TR}$ of the moving blade obeys the following relationship:

$$0.1 \leq h_{TR}/D_{TR} \leq 0.2,$$

preferentially $0.12 \leq h_{TR}/D_{TR} \leq 0.18$, most preferably $0.13 \leq h_{TR}/D_{TR} \leq 0.16$.

According to another advantageous further development, an overlap $\Delta$ of two adjacent guide blades in the closed position and the length of a guide blade $L_{LS}$ satisfies the following relationship:

$$0.05 * L_{LS} \leq \Delta \leq 0.4 * L_{LS},$$

preferentially $0.1 * L_{LS} \leq \Delta \leq 0.3 * L_{LS}$, most preferentially $0.15 * L_{LS} \leq \Delta \leq 0.2 * L_{LS}$.

Particularly favourable in terms of production prove to be two embodiments in which the exhaust gas turbocharger comprises 11 guide blades and 9 moving blades or 13 guide blades and 11 moving blades.

In a particularly preferred embodiment, the origin of a Cartesian coordinate system is defined by the first profile nose facing away from the turbine wheel. An X-direction of the Cartesian coordinate system is defined by the profile chord, wherein accordingly a Y-direction of the Cartesian coordinate system extends orthogonally to the X-direction away from the first profile nose. The guide blades in longitudinal profile each have a profile bottom side which in each case is formed concave in sections and convex in sections each with a low point $P_1$ and a high point $P_2$ and in each case a convexly formed profile top side with a high point $P_3$. The spacing $x_p$ between first profile nose and the guide blade centre of rotation P and the spacing $x_1$ between a profile nose and the low point $P_1$ satisfy the following relationship in X-direction:

$$(x_p - x_1)/x_p > 0.8.$$

In addition, the spacing $x_1$ and the spacing $y_1$ between a first profile nose and the low point $P_1$ in Y-direction satisfy the following relationship:

$$y_1/x_1 < 0.4.$$

To further reduce the aerodynamic forces acting on the guide blades, the guide blades in a preferred embodiment each have a profile bottom side in the longitudinal profile that is formed concave in sections and convex in sections each with a low point $P_1$ and a high point $P_2$. Furthermore, the guide blades each have a convexly formed profile top side with a high point $P_3$. Here, the origin of a Cartesian coordinate system is defined by the first profile nose facing away from the turbine housing and an X-direction of said Cartesian coordinate system is defined by the profile chord. The Y-direction of the Cartesian coordinate system extends away from the first profile nose orthogonally to the X-direction. According to this embodiment, the spacing $x_p$ between a first profile nose and the guide blade centre of rotation P in X-direction and the spacing $x_1$ between first profile nose and the low point $P_1$ each satisfy the following relationship:

$$(x_p - x_1)/x_p > 0.8;$$

At the same time, the spacing $x_1$ and the spacing $y_1$ between first profile nose $x_1$ and the low point $P_1$ satisfy the following relationship in Y-direction:

$$y_1/x_1 < 0.4.$$

In an advantageous further development, a centre line is defined in the longitudinal profile by a plurality of construction circles, wherein for the radius of the first construction circle defining the first profile nose one of the two satisfies the following relationships:

$$r/x_p > 0.08 \text{ or } r/x_p < 0.045.$$

The construction circles in this case lie with their centre point on the centre line and are tangent to the profile bottom side and top side.

Particularly practically, the following relationships apply in longitudinal profile of a guide blade for the diameter $k_1$ of a first construction circle assigned to the first profile nose, to the diameter $k_2$ of one of the first construction circles assigned to the second profile nose and the construction circle with maximum diameter $k_{max}$:

$$1 \leq k_{max}/k_1 \leq 20, \text{ and}$$

$$1 \leq k_{max}/k_2 \leq 10.$$

In a particularly advantageous embodiment, which further improves the efficiency of the exhaust gas turbocharger with variable turbine geometry, the following relationships are satisfied:

$0.03 \leq r/x_p$, preferentially $0.07 \leq r/x_p$, most preferably $0.11 \leq r/x_p$.

In a particularly preferred embodiment, the following relationship applies to the guide blade geometry: $r/x_p \leq 0.4$, preferentially $r/x_p \leq 0.38$, most preferentially $r/x_p \leq 0.35$.

According to a further particularly practical embodiment, the X and Y-coordinates of the following points are defined in the Cartesian coordinate system:

$x_p$, $y_p$: Cartesian coordinates of the guide blade centre of rotation P, $x_1$, $y_1$: low point $P_1$ of the convex profile bottom side, $x_2$, $y_2$: height $P_2$ of the concave profile bottom side, $x_3$, $y_3$: height $P_3$ of the convex profile top side, $x_4$, $y_4$: high point $P_4$ of the centre line, $x_5$, $y_5$: first intersection $P_5$ of the convex profile bottom side with the profile chord, $x_6$, $y_6$: second intersection $P_6$ of the concave profile bottom side with the profile chord.

Here, the following relationships apply to the low point $P_1$ and the high point $P_2$ and to the centre of rotation P:

$$0 \le y_p/y_4 \le 2,$$

$$0 \le y_p/y_1 \le 5,$$

$$0 \le y_2/y_p \le 0.7, \text{ and}$$

$$0 \le y_3/y_1 \le 5.$$

In a preferred embodiment in order to further reduce the aerodynamic forces acting on the guide blades, a length $L_{Profile\ chord}$ of the profile chord satisfies the following relationship:

$0.3L_{Profile\ chord} < x_p < 0.5L_{Profile\ chord}$, wherein $x_p$ is the X-coordinate of the guide blade centre of rotation.

Particularly practically, the following relationship applies in a furthering embodiment with respect to the Y-coordinate $y_3$ of the high point $P_3$ and of the guide blade centre of rotation $y_p$:

$0 \le y_p/y_3 \le 1$, preferentially $0 \le y/y_3 \le 0.5$, most preferably $0 \le y_p/y_3 \le 0.25$.

In a furthering embodiment, the coordinates $x_1$, $y_1$ of the low point $P_1$ of the convex profile bottom side satisfy the following relationship: $0 \le |y_1|/x_1 \le 1.5$, preferentially $0.8 \le |y_1|/x_1 \le 1.4$, most preferably $1.0 \le |y_1|/x_1 \le 1.3$.

In an embodiment that is efficiency-optimised to a particular degree the following applies to the relationship between the respective X-coordinates of the guide blade centre of rotation $x_p$ and of the low point $P_1$ of the convex profile bottom side $x_1$:

$0.8 \le (x_p - x_1)/x_p$, preferentially $0.9 \le (x_p - x1)/x_p$, most preferably $0.99 \le (x_p - x1)/x_p$.

In an embodiment that is alternative to this with likewise optimised efficiency, the following by contrast applies to the relationship between the respective X-coordinates $x_p$, $x_1$ of the guide blade centre of rotation P and the low point $P_1$ of the convex profile bottom side $x_1$: $(x_p - x_1)/x_p \le 0.3$, preferentially $(x_p - x_1)/x_p \le 0.2$, most preferentially $(x_p - x_1)/x_p \le 0.1$.

To further optimise the inflow of the guide blades, the geometry of the longitudinal profile of the guide blades satisfies the following relationships in a particularly preferred embodiment:

$$-0.7 \le (x_p - x_3)/x_p \le 0.7,$$

$$-1.5 \le (x_p - x_5)/x_p \le 1.5,$$

$$-0.7 \le (x_p - x_4)/x_p \le 0.7,$$

$$-1.7 \le (x_p - x_2)/x_p \le 1.7,$$

$$-2.0 \le (x_p - x_6)/x_p \le 1.7,$$

$$-1.5 \le (x_2 - x_5)/(x_6 - x_2) \le 1.5, \text{ and}$$

$$-1.5 \le (x_6 - x_2)/(x_2 - x_5) \le 1.5.$$

Particularly practically, the centre line can be subdivided by the guide blade centre of rotation P into a first chord with chord length $L_1$ and a second chord with chord length $L_2$, wherein with an embodiment having a particularly high efficiency the following relationship then applies:

$$0.5 \le L_1/L_2 \le 1.0,$$

preferentially $0.6 \le L_1/L_2 \le 1.0$, most preferentially: $0.7 \le L_1/L_2 \le 1$.

The invention, furthermore, relates to a motor vehicle with an internal combustion engine and to an exhaust gas turbocharger interacting with the internal combustion engine having one or multiple of the features introduced above.

Further important features and advantages of the invention are obtained from the subclaims, from the drawings and from the associated figure description with the help of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

It shows, in each case schematically

DETAILED DESCRIPTION

Figure 1A:
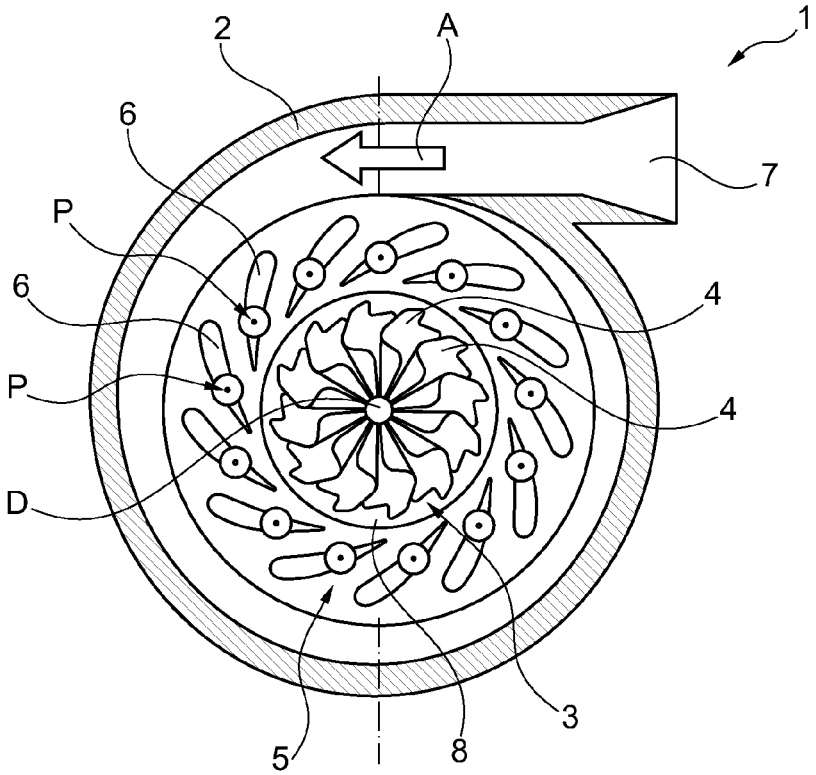
FIG. 1*a* a rough schematic representation of an exhaust gas turbocharger according to the invention with variable turbine geometry in a part view, FIG. 1*b* the variable turbine geometry of FIG. 1*a* in a detail view, FIG. 2 a guide blade of the variable turbine geometry in a longitudinal profile, FIG. 3 the longitudinal profile of FIG. 2 with respective construction circles defining a guide blade.

In FIG. 1*a*, an exhaust gas turbocharger according to the invention is shown in a rough schematic manner in a part view and marked with the reference character 1. The exhaust gas turbocharger 1 comprises a turbine housing 2 with a turbine wheel 3 comprising a first number of moving blades 4, which in the FIG. 1 are only shown in a rough schematic manner. The turbine wheel 3 is rotatable about a turbine wheel centre of rotation D relative to the turbine housing 2.

The exhaust gas turbocharger 1 furthermore comprises a variable turbine geometry 5, which comprises a blade bearing ring which is not shown in the schematic representation of FIG. 1, on which a second number of guide blades 6 is rotatably mounted in each case about a guide blade centre of rotation P. The second number of guide blade 6 in this case is distinct from the first number of moving blades 4. In the example shown in FIG. 1*a*, the turbine wheel 3 exemplarily comprises twelve moving blades 4 and the variable turbine geometry 5 thirteen guide blades 6; obviously, in version another number of guide blades 6 and moving blades 4 respectively is also possible.

Figure 1B:
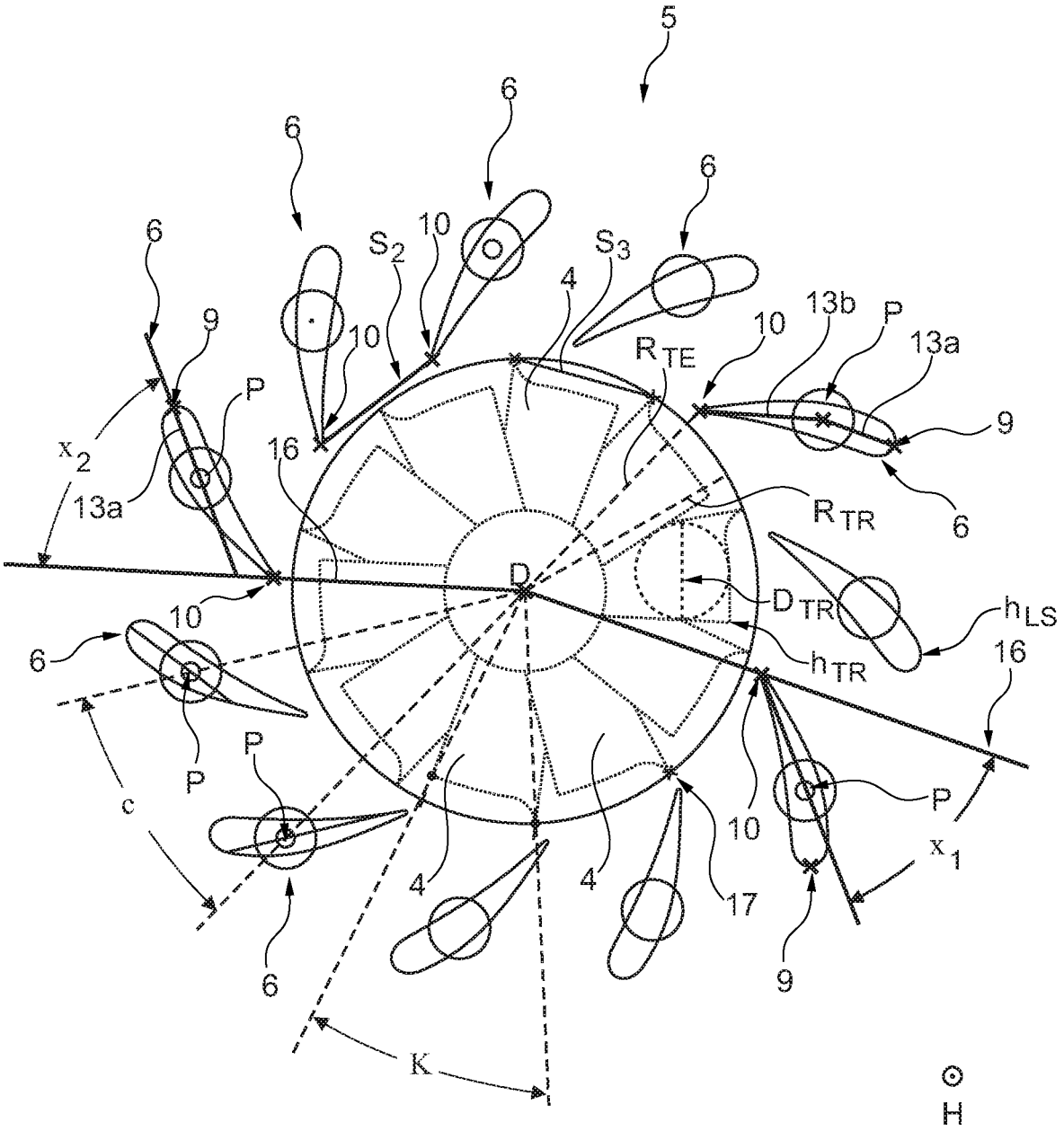

For example, a variable turbine geometry 5 with eleven guide blades 6 and ten moving blades 4 is shown in a rough schematic manner for example in FIG. 1*b*. The guide blades 6 are adjustable between a closed position, in which a flow cross section between the guide blades 6 for exhaust gas to flow through is minimal and an opened position, in which this flow cross section is maximal.

In the example of FIG. 1*a*, the turbine housing 2 has a volute-like geometry as well as an inlet opening 7 and an outlet opening 8. By means of the turbine wheel 3 a high-pressure region which is fluidically connected to the inlet opening 7 is separated from a low-pressure region which is fluidically connected to the outlet opening 8.

For adjusting the guide blades 6 between the opened and the closed position, the variable turbine geometry 5 can comprise an adjusting element with a respective mounting which is not shown in the FIGS. 1*a/b* for the sake of clarity, wherein each guide blade 6 engages in such a mounting of the adjusting element via a respective adjusting lever. Obviously, other realisations for adjusting the guide blades 6 between the opened and the closed position or an intermediate position are also conceivable in versions.

Figure 2:
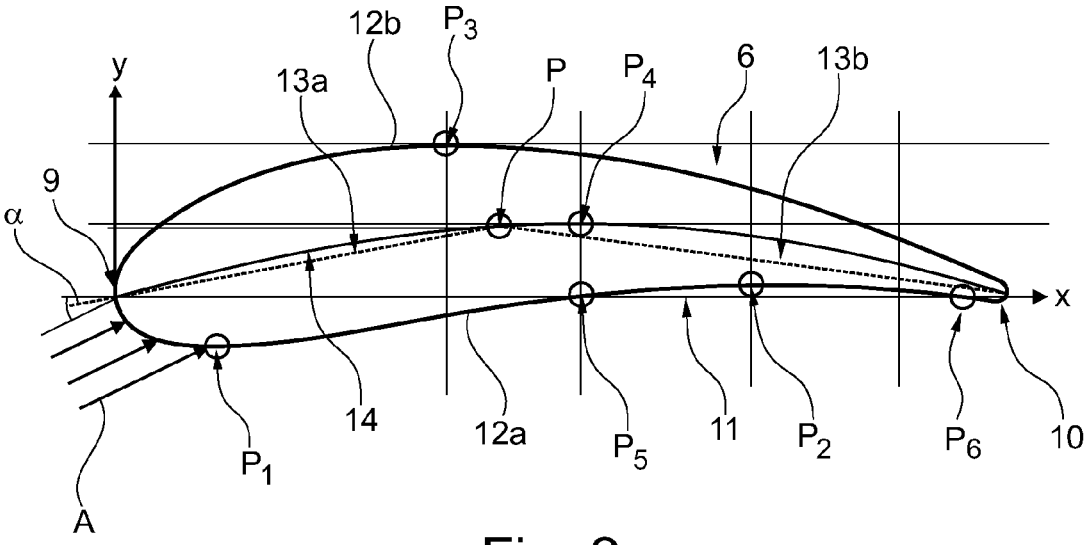

FIG. 2 now shows a guide blade 6 of the variable geometry 5 in a longitudinal section. The guide blade 6 in the longitudinal profile comprises a first profile nose 9 and a second profile nose 10. A profile chord 11 is defined by the connecting line between the two profile noses 9, 10.

From FIG. 1*b* it is evident in turn that the spacing $R_{TE}$ of the second profile nose from the turbine wheel centre of rotation in the opened position of the guide blades and the radius of the turbine wheel $R_{TR}$ according to the invention satisfy the following relationship:

$$1.03 \leq R_{TE}/R_{TR} \leq 1.06.$$

Such dimensioning of the variable turbine geometry 5 reduces undesirable excitation oscillations or oscillation loads on the guide blades 4 to a considerable degree which has a positive effect on the thermodynamic efficiency of the exhaust gas turbocharger 1. At the same time, the adjusting forces which are needed for moving the guide blades 4 are minimised. Similarly, the hysteresis behaviour of the variable turbine geometry 5 is minimised, as a result of which particularly good control behaviour can be achieved.

Particularly advantageous with respect to the efficiency that can be achieved is a version in which the spacing $R_{TE}$ and the radius $R_{TR}$ satisfy the following relationship:

$$1.04 \leq R_{TE}/R_{TR} \leq 1.06, \text{ preferentially even } 1.05 \leq R_{TE}/R_{TR} \leq 1.06.$$

Again looking at the representation of FIG. 2 it is evident that in the longitudinal profile of the guide blade 6 its centre line 14 is subdivided by the guide blade centre of rotation P into a first chord 13*a* with chord length $L_1$ and a second chord 13*b* with chord length $L_2$. The first chord 13*a* in this case is defined by a connecting straight line of the guide blade centre of rotation P with the first profile nose 9 and the second chord 13*b* by a connecting straight line of the guide blade centre of rotation P with the second profile nose 10. In the example scenario of the figures, the guide blades 6 are now designed in such a manner that exhaust gas entering the turbine housing 2 strikes the guide blade 6 at an inflow angle $\alpha < 4°$ relative to the first chord 13*a* when the guide blades 6 are in their closed position.

FIG. 1*b* shows an angle $\xi_2$ between a connecting straight line 16 connecting the turbine wheel centre of rotation D and to the second profile nose 10 and the first chord 13*a*. In the exemplary scenario, is in the angle interval $35° \leq \xi_2 \leq 55°$, in the case that the guide blades 6 are in the opened position and in the angle range $95° \leq \xi_2 \leq 110°$, in the case that the guide blades 6 are in the closed position. In addition, an angle $\xi_1$ between the connecting straight line 16 connecting the turbine wheel centre of rotation D and the second profile nose 10 and the second chord 13*b* satisfies one of the two following relationships:

$$1.4 \leq \xi_2/\xi_1 \leq 1.6, \text{ or } 1.2 \leq \xi_2/\xi_1 \leq 1.4.$$

The angle X formed as apex with respect to the turbine wheel centre of rotation D between two adjacent guide blade centres of rotation P and the opening angle κ of a moving blade 6 in the longitudinal section obey the following relationship:

$$0.4 \leq \chi/\kappa \leq 2.4. \text{ In a version, } 0.6 \leq \chi/\kappa \leq 1.7, \text{ even applies, and in a particularly preferred version } 0.9 \leq \chi/\kappa \leq 1.2.$$

From FIG. 1*b* it is evident furthermore that the length $S_2$ of the connecting line of two adjacent second profile noses 10 in the opened state of the guide blade 6 and the inlet width $S_3$ between two adjacent moving blades 4 obey the following relationship: $0.45 \leq S_2/S_3 \leq 3.2$. In a version, $0.65 \leq S_2/S_3 \leq 1.7$, even applies, in a particularly preferred version $0.92 \leq S_2/S_3 \leq 1.25$. The ratio of a flow area $A_{TR}$ (not shown in the figures) between two moving blades 4 with respect to the inlet area between two guide blades 6 $A_{LS}$ (likewise not shown in the figures) obeys the following relationship: $0.36 \leq A_{LS}/A_{TR} \leq 3.82$. In a version, $0.52 \leq A_{LS}/A_{TR} \leq 2.05$, even applies. In a further version, even $0.74 \leq A_{LS}/A_{TR} \leq 1.5$. Here, the inlet area $A_{TR}$ between two moving blades 4 is defined by the relationship $A_{TR} = h_{TR}\ S_3$ and the inlet area $A_{LS}$ between two guide blades 6 by the relationship $A_{LS} = h_{LS}\ S_2$. Here, $h_2$ is the height of the guide blades 6 along their axis of rotation—in FIG. 1*b*, only the centre of rotation P is evident through which the axis of rotation runs—and $h_3$ the height of the moving blade at the turbine wheel inlet, which in FIG. 1*b* has been exemplarily marked with the reference number 17 for a moving blade 4.

Finally, the following relationship applies to the ratio of a height $h_{TR}$ of a moving blade 4 to the height $h_{LS}$ of a guide blade 6: $0.8 \leq h_{LS}/h_{TR} \leq 1.2$. Again $0.9 \leq h_{LS}/h_{TR} \leq 1.1$ applies in a version. The mentioned heights $h_{TR}$, $h_{LS}$ in this case relate to a vertical direction H arranged orthogonally to the drawing direction of the figures. For the ratio of a diameter $D_{TR}$ of a moving blade 4 to the height $h_{TR}$ of the moving blade 4 the following relationship applies: $0.1 \leq h_{TR}/D_{TR} \leq 0.2$. In a preferred version, $0.12 \leq h_{TR}/D_{TR} \leq 0.18$, applies and in a further version even $0.13 \leq h_{TR}/D_{TR} \leq 0.16$.

In the example of the figures, an overlap of two adjacent guide blades 6 in the closed position and the length of a guide blade $L_{LS}$ furthermore applies:

$$0.05 * L_{LS} \leq \Delta \leq 0.4 * L_{LS}, \text{ preferentially } 0.1 * L_{LS} \leq \Delta \leq 0.3 * L_{LS}, \text{ most preferentially } 0.15 * L_{LS} \leq \Delta \leq 0.2 * L_{LS}.$$

Here, Δ of the overlap region of two adjacent guide blades 6—extends in their longitudinal profile—in their closed position, which consequently extends from a first profile nose 9 of a certain guide blade 6 as far as to the second profile nose 10 of the guide blade 6 that is adjacent to this guide blade 4.

As shown in FIG. 2, the guide blade 6 in the longitudinal profile can each have a profile bottom side 12*a* which in sections is formed in a convex manner and a profile top side 12*b* which is formed in a convex manner. The section of the profile bottom side 12*a* formed in a convex manner then has a low point $P_1$. Likewise, the section of the profile bottom side 12*a* formed in a concave manner has a high point $P_2$, the profile top side 12*b* a high point $P_3$.

From the representation of FIG. 2 it is also evident that the first profile nose 9 facing away from the turbine wheel 3 determines the original of a Cartesian coordinate system. An X-direction of this coordinate system is defined by the profile chord 11. Accordingly, a Y-direction of the coordinate system extends orthogonally to the X-direction away from the first profile nose 9. The spacing $x_p$ between first profile nose 9 and the guide blade centre of rotation P and the spacing $x_1$ between first profile nose 9 and low point $P_1$ in X-direction satisfy the following relationship: $(x_p-x_1)/x_p>0.8$.

Accordingly, the spacing $x_1$ defined above and the spacing $y_1$ between first profile nose 9 and the low point $P_1$ satisfy the following relationship in Y-direction: $y_1/x_1\leq 0.4$.

Figure 3:
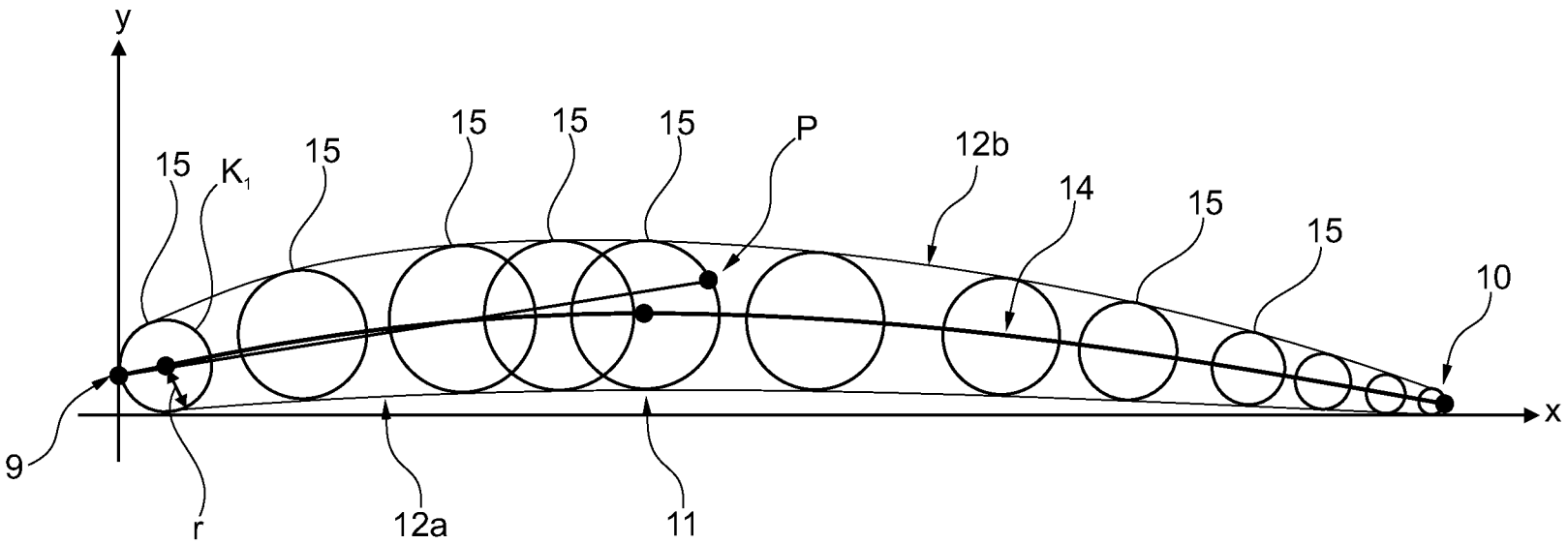

Looking now at the representation of FIG. 3, which shows the guide blade 6 analogously to FIG. 2 in a longitudinal profile it is evident that in the longitudinal profile of the guide blade 6 a centre line 14 is defined by a plurality of construction circles 15 between the profile top side 12*b* and the profile bottom side 12*a*. With respect to the radius r of the first construction circle $K_1$ defining the first profile nose 9 the condition $r/x_p>0.08$ or $r/x_p<0.045$ applies.

With respect to the X-coordinate $x_p$ of the guide blade centre of rotation P $0.03\leq r/x_p$, preferentially $0.07\leq r/x_p$, most preferentially $0.1\leq r/x_p$ applies in a version of the exemplary embodiment. In a version that is alternative to this, $r/x_p\leq 0.4$, preferentially $r/x_p\leq 0.38$, most preferentially $r/x_p\leq 0.35$ applies by contrast.

In the longitudinal profile of the guide blade 6 shown in the example of FIG. 3 the following relationships apply to the diameter $k_1$ of a first construction circle $\mathbf{15}_1$ assigned to the first profile nose 9, for the diameter $k_2$ of a first construction circle $\mathbf{15}_2$ assigned to the second profile nose 10 and the construction circle $\mathbf{15}_{max}$ with maximum diameter $k_{max}$:

$1\leq k_{max}/k_1\leq 20$, and $1\leq k_{max}/k_2\leq 10$.

In the Cartesian coordinate system show in the FIGS. 2 and 3 the following points are thus defined as already explained above, by the X and Y-coordinates:

- the Cartesian coordinates $x_p$, $y_p$ of the guide blade centre of rotation P,
- the Cartesian coordinates $x_1$, $y_1$ of the low point $P_1$ of the convex profile bottom side 12*a*,
- the Cartesian coordinates $x_2$, $y_2$ of the high point $P_2$ of the concave profile bottom side 12*a*,
- the Cartesian coordinates $x_3$, $y_3$ of the high point $P_3$ of the convex profile top side 12*b*.

Furthermore, an intersection $P_5$ of the convex profile bottom side 12*a* with the profile chord 11 is defined in the longitudinal profile of the guide blade 6 according to FIG. 2, which in the Cartesian coordinate system has the X and Y-coordinate $x_5$, $y_5$ respectively. Accordingly, an intersection $P_6$ of the concave profile bottom side 12*a* with the profile chord 11 is also defined in the longitudinal profile of the guide blades 6, which in the Cartesian coordinate system has the X and Y-coordinate $x_6$, $y_6$ respectively. Through the Cartesian coordinates $x_4$, $y_4$, a high point $P_4$ of the centre line 14 is defined.

The following relationships apply to the extreme points $P_1$, $P_2$, $P_3$, $P_4$, for the intersections $P_5$ and $P_6$ defined above and to the guide blade centre of rotation P of the guide blade 6 in the longitudinal profile shown in FIG. 2 which is improved compared with conventional guide blades:

$$-0.7\leq(x_p-x_3)/x_p\leq 0.7,$$

$$-1.5\leq(x_p-x_5)/x_p\leq 1.5,$$

$$-0.7\leq(x_p-x_4)/x_p\leq 0.7,$$

$$-1.7\leq(x_p-x_2)/x_p\leq 1.7,$$

$$-2.0\leq(x_p-x_6)/x_p\leq 1.7,$$

$$-1.5\leq(x_2-x_5)/(x_6-x_2)\leq 1.5,$$

$$-1.5\leq(x_6-x_2)/(x_2-x_5)\leq 1.5.$$

At the same time the following applies:

$$0\leq y_p/y_4\leq 2;$$

$$0\leq y_p/y_1\leq 5;$$

$$0\leq y_2/y_p\leq 0.7;$$

$$0\leq y_3/y_1\leq 5.$$

For the position of the spacing $x_p$ of the guide blade centre of rotation P from the first profile nose 9 in X-direction the following applies:

$$0.3L_{Profile\ chord}<x_p<0.5L_{Profile\ chord},$$

wherein $L_{Profile\ chord}$ is the length of the profile chord 11.

At the same time, the non-equation $0\leq y_p/y_3\leq 1$ can apply to the Y-coordinate of the guide blade centre of rotation P relative to the Y-coordinate of the high point $P_3$ of the convex profile top side 12*b*. According to a preferred version even $0.6\leq y_p/y_3\leq 0.9$, and according to a particularly preferred version $0.65\leq y_p/y_3\leq 0.73$.

Furthermore, the following applies to the Cartesian coordinates $x_1$, $y_1$ of the first extreme point $P_1$. According to a preferred version the following applies: $0\leq y_1/x_1\leq 0.4$, preferentially $0\leq x_1/y_1\leq 0.3$, particularly preferably even $0\leq y_1/x_1\leq 0.2$. However, alternatively to this, the following relationships can also apply: $0.80\leq y_1/x_1\leq 1.5$, in a preferred version $0.90\leq y_1/x_1\leq 1.3$, most preferentially $1.0\leq y_1/x_1\leq 1.1$.

Furthermore, the relationship $0.8\leq(x_p-x_1)/x_p$, preferentially $0.9\leq(x_p-x1)/x_p$, and most preferentially $0.99\leq(x_p-x_1)/x_p$ can apply to the X-coordinate $x_1$ of the low point $P_1$ and the X-coordinate $x_p$ of the guide blade centre of rotation P. In a version which is alternative thereto, the guide blade 6 by contrast satisfies the following conditions in the longitudinal profile:

$(x_p-x_1)/x_p\leq 0.3$, preferentially$(xp-x1)/x_p\leq 0.2$, most preferentially $(x_p-x_1)/x_p\leq 0.1$.

Looking at the longitudinal profile of FIG. 2 it is evident that the centre line 14 between profile bottom side 12*a* and profile top side 12*b* is subdivided by the guide blade centre of rotation P into the first chord 13*a* with chord length $L_1$ and into the second chord 13*b* with chord length $L_2$. The two chords 13*a*, 13*b* are connecting lines of the centre of rotation P with the first or second profile nose 9, 10. The relationship between $L_1$ and $L_2$ of the guide blade 6 in this case is $0.5\leq L_1/L_2\leq 1.0$. Preferentially, $0.6\leq L_1/L_2\leq 1.0$, most preferentially even $0.7\leq L_1/L_2\leq 1$ applies.

The invention claimed is:

1. An exhaust gas turbocharger, comprising:

a turbine housing;

a turbine wheel including a first quantity of a plurality of moving blades, the turbine wheel being rotatable relative to the turbine housing about a turbine wheel centre of rotation and having a turbine wheel radius ($R_{TR}$);

a variable turbine geometry including a blade bearing ring and a second quantity of a plurality of guide blades disposed on the blade bearing ring, the plurality of guide blades respectively rotatably mounted about a guide blade centre of rotation, wherein the plurality of guide blades are adjustable between a closed position where a flow cross section between the guide blades for an exhaust gas to flow through is at a minimum and an opened position where the flow cross section is at a maximum;

wherein each of the plurality of guide blades in a longitudinal profile includes a first profile nose facing away from the turbine wheel centre of rotation and a second profile nose facing towards the turbine wheel centre of rotation, and a straight connecting line between the first profile nose and the second profile nose defining a profile chord;

wherein a spacing ($R_{TE}$) of the second profile nose from the turbine wheel centre of rotation in the opened position of the guide blades and the turbine wheel radius ($R_{TR}$) satisfy the following relationship: $1.03 \leq R_{TE}/R_{TR} \leq 1.06$; and wherein an angle ($\chi$) formed as an apex point with respect to the turbine wheel centre of rotation between two adjacent guide blade centres of rotation and an opening angle ($\kappa$) of at least one of the plurality of moving blades in a longitudinal section satisfy the following relationship: $0.4 \leq \chi/\eta \leq 2.4$.

2. The exhaust gas turbocharger according to claim 1, wherein the spacing ($R_{TE}$) and the turbine wheel radius ($R_{TR}$) satisfy the following relationship:

$$1.04 \leq R_{TE}/R_{TR} \leq 1.06.$$

3. The exhaust gas turbocharger according to claim 1, wherein:

the longitudinal profile of the respective guide blades includes a centre line, the centre line being divided by the guide blade centre of rotation into a first chord with a first chord length and a second chord with a second chord length and wherein the first chord is defined by a first connecting straight line of the guide blade centre of rotation with the first profile nose and the second chord is defined by a second connecting straight line of the guide blade centre of rotation with the second profile nose.

4. The exhaust gas turbocharger according to claim 3, wherein the plurality of guide blades are configured such that the exhaust gas entering the turbine housing strikes the guide blade at an inflow angle <4° relative to the first chord when the guide blades are in the closed position.

5. The exhaust gas turbocharger according to claim 3, wherein an angle ($\xi_2$) between (i) a third connecting straight line connecting the turbine wheel centre of rotation and the second profile nose and (ii) the first chord lies in the following angle interval:

$35° \leq \xi_2 \leq 55°$, when the guide blades are in the opened position, and $95° \leq \xi_2 \leq 110°$, when the guide blades are in the closed position.

6. The exhaust gas turbocharger according to claim 3, wherein a first angle ($\xi_1$) between (i) a third connecting straight line connecting the turbine wheel centre of rotation and the second profile nose and (ii) the second chord with respect to a second angle ($\xi_2$) between (i) a fourth connecting straight line connecting the turbine wheel centre of rotation and the second profile nose and (ii) the first chord satisfies at least one of the following relationships:

$$1.4 \leq \xi_2/\xi_1 \leq 1.6, \text{ and}$$

$$1.2 \leq \xi_2/\xi_1 \leq 1.4.$$

7. The exhaust gas turbocharger according to claim 1, wherein a ratio of a flow area ($A_{TR}$) between two moving blades with respect to an inlet area ($A_{LS}$) between two guide blades obeys the following relationship:

$$0.36 \leq A_{LS}/A_{TR} \leq 3.82.$$

8. The exhaust gas turbocharger according to claim 1, wherein a ratio of a height ($h_{TR}$) of one of the plurality of moving blades with respect to a height ($h_{LS}$) of one of the plurality of guide blades obeys the following relationship:

$$0.8 \leq h_{LS}/h_{TR} \leq 1.2.$$

9. The exhaust gas turbocharger according to claim 1, wherein a ratio of a diameter ($D_{TR}$) of at least one of the plurality of moving blades with respect to a height ($h_{TR}$) of the at least one of the plurality of moving blades obeys the following relationship:

$$0.1 \leq h_{TR}/D_{TR} \leq 0.2.$$

10. The exhaust gas turbocharger according to claim 1, wherein the angle ($\chi$) and the opening angle ($\kappa$) further satisfy the following relationship:

$$0.6 \leq \chi/\kappa \leq 1.7.$$

11. The exhaust gas turbocharger according to claim 1, wherein a length ($S_2$) of a second connecting line between two adjacent second profile noses in the opened state of the guide blades and an inlet width ($S_3$) between two adjacent moving blades obey the following relationship:

$$0.92 \leq S_2/S_3 \leq 1.25.$$

12. The exhaust gas turbocharger according to claim 3, wherein the first chord length and the second chord length in the longitudinal profile of at least one of the plurality of guide blades has the following relationship: $0.5 \leq L_1/L_2 \leq 1.0$, wherein $L_1$ is the first chord length and $L_2$ is the second chord length.

13. An exhaust gas turbocharger for an internal combustion engine, comprising:

a turbine housing and a turbine wheel disposed therein rotatable relative to the turbine housing about a turbine wheel centre of rotation, the turbine wheel defining a turbine wheel radius ($R_{TR}$) and including a plurality of moving blades;

a variable turbine geometry including a blade bearing ring and a plurality of guide blades rotatably mounted about a guide blade centre of rotation on the blade bearing ring, the plurality of guide blades adjustable between a closed position where a flow cross-section between the respective guide blades for an exhaust gas flow is at a minimum, and an opened position where the flow cross-section is at a maximum;

the plurality of guide blades respectively having in a longitudinal profile a first profile nose facing away from the turbine wheel centre of rotation, a second profile nose facing towards the turbine wheel centre of rotation, and a profile chord defined by a first connecting line between the first profile nose and the second profile nose;

wherein a spacing ($R_{TE}$) of the second profile nose from the turbine wheel centre of rotation in the opened position of the plurality of guide blades and the turbine wheel radius ($R_{TR}$) satisfy the following relationship: $1.03 \leq R_{TE}/R_{TR} \leq 1.06$; and wherein a length ($S_2$) of a second connecting line between two adjacent second profile noses in the opened position of the guide blades and an inlet width ($S_3$) between two adjacent moving blades satisfy the following relationship: $0.45 \leq S_2/S_3 \leq 3.2$.

14. The exhaust gas turbocharger according to claim 13, wherein the length ($S_2$) and the inlet width ($S_3$) further satisfy the following relationship: $0.65 \leq S_2/S_3 \leq 1.7$.

15. An exhaust gas turbocharger for an internal combustion engine, comprising:

a turbine housing and a turbine wheel disposed therein rotatable relative to the turbine housing about a turbine wheel centre of rotation, the turbine wheel defining a turbine wheel radius ($R_{TR}$) and including a plurality of moving blades;

a variable turbine geometry including a blade bearing ring and a plurality of guide blades rotatably mounted about a guide blade centre of rotation on the blade bearing ring, the plurality of guide blades adjustable between a closed position where a flow cross-section between the respective guide blades for an exhaust gas flow is at a minimum, and an opened position where the flow cross-section is at a maximum;

the plurality of guide blades respectively having in a longitudinal profile a first profile nose facing away from the turbine wheel centre of rotation, a second profile nose facing towards the turbine wheel centre of rotation, and a profile chord defined by a connecting line between the first profile nose and the second profile nose;

wherein a spacing ($R_{TE}$) of the second profile nose from the turbine wheel centre of rotation in the opened position of the plurality of guide blades and the turbine wheel radius ($R_{TR}$) satisfy the following relationship: $1.03 \leq R_{TE}/R_{TR} \leq 1.06$; and wherein the first profile nose in the longitudinal profile of at least one guide blade of the plurality of guide blades defines an origin of a Cartesian coordinate system with an X-coordinate extending along the profile chord and a Y-coordinate extending orthogonally to the X-coordinate, the X-coordinate and the Y-coordinate of the following points being defined in the Cartesian coordinate system:

$x_p$, $y_p$: Cartesian coordinates of the guide blade centre of rotation, $x_1$, $y_1$: a low point of a profile bottom side having a convex shape, $x_2$, $y_2$: a height of the profile bottom side having a concave shape, $x_3$, $y_3$: a height of a profile top side having a convex shape, $x_4$, $y_4$: a high point of a centre line of the longitudinal profile, $x_5$, $y_5$: an intersection of the profile bottom side having the convex shape with the profile chord, $x_6$, $y_6$: an intersection of the profile bottom side having the concave shape with the profile chord; and wherein the at least one guide blade in the longitudinal profile includes the following relationship:

$$0 \leq y_p/y_4 \leq 2;$$

$$0 \leq y_p/y_1 \leq 5; \text{ and}$$

$$0 \leq y_2/y_p \leq 0.7.$$

16. The exhaust gas turbocharger according to claim 15, wherein the at least one guide blade in the longitudinal profile further includes the following relationship:

$$0.3\ L_{Profile\ chord} < x_p < 0.5\ L_{Profile\ chord};$$

wherein $L_{Profile\ chord}$ is a length of the profile chord.

17. The exhaust gas turbocharger according to claim 15, wherein the at least one guide blade in the longitudinal profile further includes at least one of the following relationships:

$$0 \leq y_p/y_3 \leq 1; \text{ and}$$

$$0 \leq y_3/y_1 \leq 5.$$

18. The exhaust gas turbocharger according to claim 15, wherein the at least one guide blade in the longitudinal profile further includes the following relationship:

$$0 \leq |y_1|/x_1 \leq 1.5.$$

19. The exhaust gas turbocharger according to claim 15, wherein the at least one guide blade in the longitudinal profile further includes one of the following relationships:

$$0.8 \leq (x_p - x_1)/x_p; \text{ and}$$

$$0.3 \geq (x_p - x_1)/x_p.$$

20. The exhaust gas turbocharger according to claim 15, wherein the at least one guide blade in the longitudinal profile further includes the following relationships:

$$0.7 \leq (x_p - x_3)/x_p \leq 0.7;b$$

$$1.5 \leq (x_p - x_5)/x_p \leq 1.5;$$

$$0.7 \leq (x_p - x_4)/x_p \leq 0.7;$$

$$1.7 \leq (x_p - x_2)/x_p \leq 1.7;$$

$$1.5 \leq (x_2 - x_5)/(x_6 - x_2) \leq 1.5; \text{ and}$$

$$1.5 \leq (x_6 - x_2)/(x_2 - x_5) \leq 1.5.$$

* * * * *